US005339614A

United States Patent [19]

Witschi

[11] Patent Number: 5,339,614

[45] Date of Patent: Aug. 23, 1994

[54] ROTATING DISC FOR SEPARATING AND PROCESSING THE END OF YARN

[75] Inventor: Martin Witschi, Schaffhausen, Switzerland

[73] Assignee: Maschinenfabrik Rieter AG, Winterthur, Switzerland

[21] Appl. No.: 986,595

[22] Filed: Dec. 7, 1992

Related U.S. Application Data

[63] Continuation-in-part of Ser. No. 919,876, Jul. 27, 1992, and a continuation-in-part of Ser. No. 728,555, Jul. 11, 1991, Pat. No. 5,313,775.

[30] Foreign Application Priority Data

Dec. 6, 1991 [CH] Switzerland ..... 03599/91

[51] Int. Cl.[5] ..... D01H 13/18; B65H 54/71

[52] U.S. Cl. ..... 57/87; 57/352; 242/19

[58] Field of Search ..... 57/263, 301, 352, 86, 57/87; 242/19

[56] References Cited

U.S. PATENT DOCUMENTS

| | | | |
|---|---|---|---|
| 2,772,054 | 11/1956 | Herele et al. | 242/19 |
| 3,491,526 | 1/1970 | Krauss et al. | 242/19 |
| 3,924,393 | 12/1975 | Stahlecker | 57/263 |
| 3,962,855 | 6/1976 | Stahlecker | 57/263 |
| 4,489,544 | 12/1984 | Morita et al. | 57/263 |
| 4,506,498 | 3/1985 | Lamb | 57/86 X |
| 4,581,881 | 4/1986 | Lamb | 57/86 X |
| 5,109,662 | 5/1992 | Inger | 57/305 |
| 5,155,987 | 10/1992 | Vogel | 57/263 X |

FOREIGN PATENT DOCUMENTS

| | | | |
|---|---|---|---|
| 0340630 | 11/1989 | European Pat. Off. . | |
| 4030658 | 4/1991 | Fed. Rep. of Germany | 242/19 |

*Primary Examiner*—Daniel P. Stodola
*Assistant Examiner*—William Stryjewski
*Attorney, Agent, or Firm*—Wolf, Greenfield & Sacks

[57] ABSTRACT

An apparatus for severing a yarn and processing the resultant end of the separated yarn comprising a controllably rotatable abrasive element (1) disposed between two yarn-tensioning mechanisms (2,3) which hold the yarn in position and under tension for engagement with an abrasive surface of the abrasive element. The abrasive element (1) is mounted stationary with respect to the yarn-tensioning mechanism (2,3) such that the yarn 4 can be wrapped around the abrasive element (1) at a predetermined angle of wrap ($\alpha$).

18 Claims, 1 Drawing Sheet

Fig.1
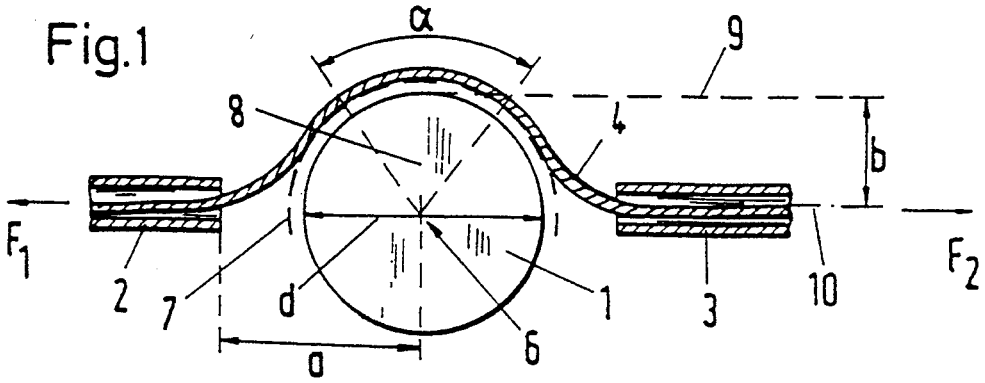
Fig.2
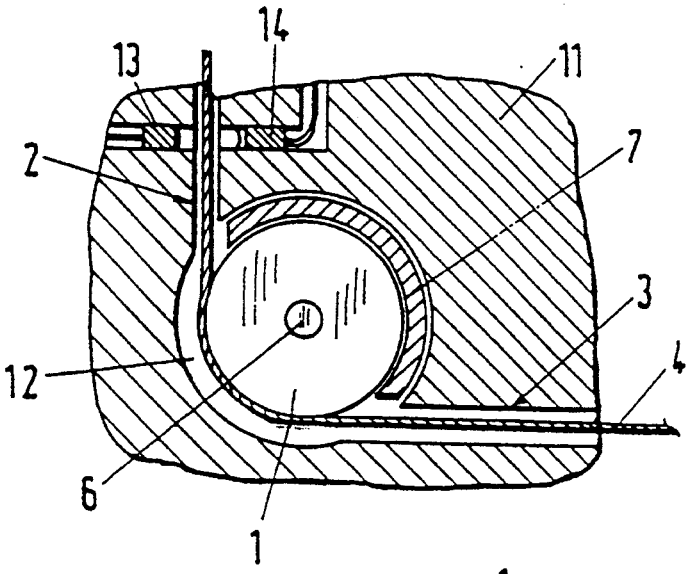
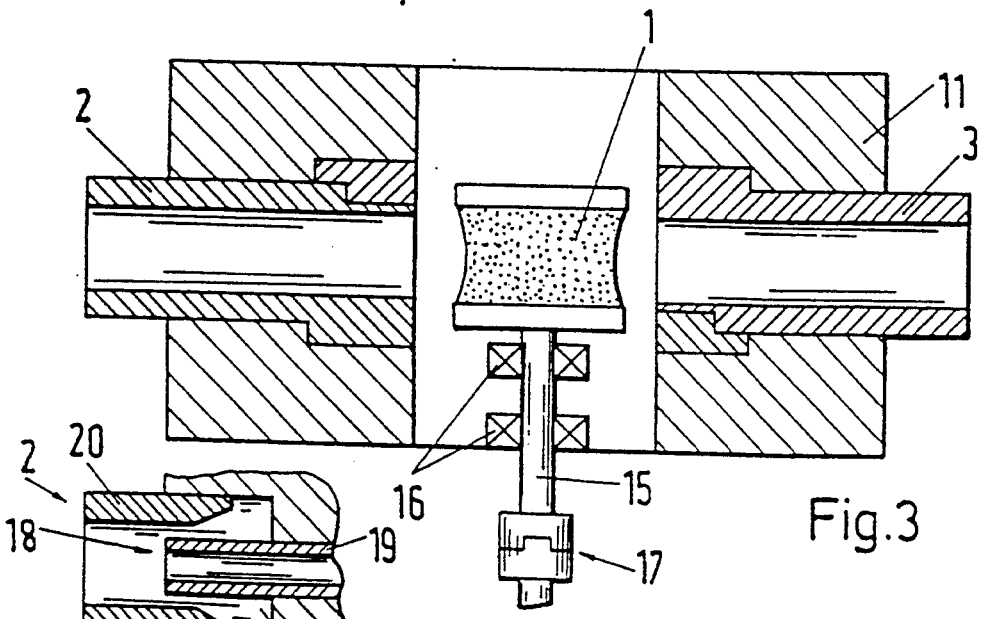
Fig.3
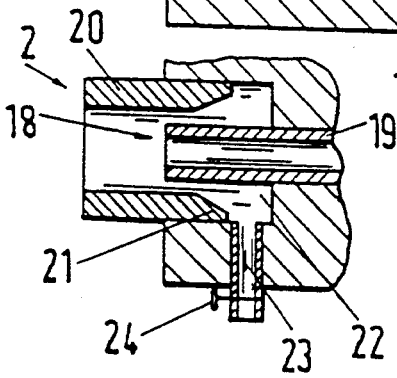
Fig. 4

ROTATING DISC FOR SEPARATING AND PROCESSING THE END OF YARN

CROSS-REFERENCE TO RELATED APPLICATIONS

This is a continuation-in-part of U.S. application Ser. No. 07/919,876 filed Jul. 27, 1992 for Method For Controlling Processing Cycles Between An Automatic Service Robot And A Spinning Position In A Textile Machine and U.S. application Ser. No. 07/728,555 filed Jul. 11, 1991, now U.S. Pat. No. 5,313,775, for Apparatus and Method For Automatic Thread Joining and Cleaning In A-Spinning Machine, the disclosures of both which are incorporated herein by reference.

BACKGROUND OF THE INVENTION

The present invention relates to apparati for separating and/or processing the end of a yarn with a rotating abrasive element.

SUMMARY OF THE INVENTION

An example of an apparatus for severing a yarn is set forth in DE-A-23 50 843, which describes a number of embodiments for abrasive elements such as a brush-like rubbing tool which is vertically reciprocated on a yarn clamped between two clamping positions and which comprises a disc-like rotating body which separates the clamped yarn. The rotating body is disposed on a pivoting arm whereby the axis of rotation of the rotating element is adjustably inclinable toward the yarn to be severed. Such prior apparati are used for start spinning a yarn in an open-end spinning aggregate, in particular in a spinning rotor.

In prior apparati of the sort mentioned above, the yarn is mechanically clamped and tensioned between the clamping positions in such a way that the yarn will snarl after the separation. This result, however, is highly undesirable for piecing or start spinning because the severed yarn end should be guided back to the spinning position for use in piecing without any additional turning or snarling.

It is an object of the invention to provide an apparatus for separating and/or processing a yarn end which preserves the structure of the separated yarn end to the maximum extent.

In accordance with the invention, therefore, there is provided an apparatus for separating and/or processing a yarn end by means of a rotating abrading element disposed between two yarn-tensioning mechanisms, characterized in that the abrasive element is in a stationary relationship with respect to the yarn-tensioning mechanisms wherein the yarn to be separated and/or processed is wrapped around the abrasive element at a predetermined angle of wrap.

Further in accordance with the invention there is provided a method for selectively forming and processing a yarn end for use in piecing or starting up spinning in a textile spinning machine, the method comprising: selecting a disc having a predetermined diameter and an abrasive circumferential surface; retrieving a spun yarn on the spinning machine; holding a portion of the retrieved yarn under tension around the abrasive surface of the disc at an angle of wrap selected to sever the yarn portion and form a yarn end having a predetermined shape; the portion of the retrieved yarn being held in a yarn holding mechanism under tension such that the yarn portion is urged toward engagement with the abrasive surface of the disc by the tension, the disc being rotatably mounted on an axis of rotation, the disc being mounted such that its axis of rotation is stationary relative to the yarn holding mechanism; and rotating the disc at one or more selected speeds and in one or more selected directions for one or more selected lengths of time to sever the portion of the retrieved yarn wrapped around the abrasive surface of the disc at the predetermined angle of wrap such that at least one severed yarn end is formed for use in piecing or start spinning in the spinning machine.

The present invention is highly advantageous over prior apparati in that the forces exerted on the yarn segment to be separated are selectively adjustable according to the properties of the yarn to be severed. The invention provides an apparatus and method for selecting an angle of wrap and an angle range for applying the abrasive effect of the abrasive element such that the resulting yarn end can be optimally prepared for the particular requirements of a given piecing process. The invention further provides for selection of a suitable grain size for the abrasive surface of the abrasive element which also contributes to achieving a shape for the end of a severed yarn which is most desired for the particular process in which the yarn end is to be pieced. A yarn end severed and prepared in accordance with the present invention is particularly useful in connection with a piecing process employed in conjunction with high-performance spinning such as air-jet spinning. A piecing process per se is described for example in the parent applications to this application and in EP-A-0 417 662, the disclosures of which are incorporated herein by reference, which describe the details of an overall apparatus and method for effecting start up spinning or piecing.

BRIEF DESCRIPTION OF THE DRAWINGS

Other advantages of the invention will be evident from the following detailed description in which exemplary embodiments are described in detail with reference to the accompanying drawings wherein:

FIG. 1 is a side, schematic cross-sectional view of an apparatus according to the invention which schematically explains the fundamental aspects of severing/preparing a yarn and yarn end by an abrasive method according to the invention;

FIG. 2 is a sectional view of another embodiment of an apparatus according to the invention having a rotatable abrasive disc with its axis stationarily mounted in a housing body which is unitary with yarn holding channels or bores;

FIG. 3 shows a partial sectional view of the FIG. 2 apparatus; and

FIG. 4 is a sectional view of a mechanism for creating a yarn holding suction force within a yarn holding tube of the apparatus shown in FIG. 3.

The same reference numerals are used in the Figures to refer to analogous elements.

DETAILED DESCRIPTION OF EXEMPLARY EMBODIMENTS

In the schematic embodiment of the invention shown in FIG. 1, the apparatus comprises a disc-like abrasive element or abrasive disc 1 having two tubes 2 and 3 arranged at opposite sides of the abrasive disc 1. The yarn 4 to be separated is held under tension by opposing forces $F_1$, $F_2$ within the two tubes 2,3. As shown in FIG. 1, the tubes 2 and 3 are arranged on opposite sides of the abrasive disc 1 and a portion of the yarn 4 extends between the tubes 2,3 and is urged toward the disc 1 by the tension in the yarn 4. As shown, a semi-cylindrical cover or shield 7 is disposed around a portion of the circumferential abrasive surface of the disc 1 and holds the portion of the yarn 4 extending between the tubes 2,3 and around the disc 1 apart from engagement with the abrasive surface on the circumference of the disc 1 in the position shown in FIG. 1. The cover 7 is mounted so as to be rotatable around the axis of rotation 6 of the abrasive disc 1 and upon controlled rotation at a selected time can thus release the yarn 4 allowing the tensioned yarn 4 to engagingly wrap around a portion of the abrasive circumferential surface of disc 1. Depending on the angle of wrap $\alpha$ which is selected, the clamped yarn 4 is separated or severed in the thus defined abrasive zone 8. Separation of the yarn 4 results in two yarn ends formed into a shape which is predetermined according to the selected angle of wrap $\alpha$. The thus formed yarn ends may be further prepared for piecing by continued controlled rotation of the disc 1 subsequent to the yarn 4 being severed.

For purposes of explanation below, the severed yarn and prepared yarn end held in tube 2 is withdrawn from tube 2 and the yarn end is ultimately mated with a fiber bundle or sliver or aggregate of fibers for piecing or start-up spinning. The opposing forces F1 and F2 acting on the clamped yarn 4 are shown in FIG. 1 by arrows. In the schematic representation of FIG. 1, distance "a" is the distance between the terminal holding end of tube 2 and the axis of disc 1, distance "b" is the distance between base line 10 and a line which is tangent to the circumferential abrasive surface of the disc 1 and parallel to base line 10. Base line 10 is defined by the position which tensioned yarn 4 would assume without abrasive disc 1 being present. The particular shape of a severed yarn end is determined by the selected angle of wrap $\alpha$ which is in turn determined by the values a and b and the diameter "d" of the disc 1. In accordance with the invention, distances a and b and the diameter of the disc 1 are preselected so as to achieve a predetermined angle of wrap $\alpha$. The quality and shape of the severed yarn end is also substantially determined by the grain size K of the abrasive circumferential surface and the diameter d of the abrasive disc 1, either or both of which values are preferably preselected.

The principal features of operation of an apparatus according to the invention by use of the abrasive element or disc 1 is as follows:

The yarn 4, FIG. 1, to be separated is elastically tensioned within and between tubes 2 and 3 and held over cover 7 with a constant tensile force $F_1$ being exerted on the left side portion of the yarn segment as shown in FIG. 1. The yarn 4 is typically brought into a position as shown in FIG. 1 by retrieving the end of a yarn on a bobbin on a spinning machine and delivering the yarn backwardly from the bobbin into and through a suction tube on a service robot such as suction tube 35 in parent application U.S. Ser. No. 919,876 or suction tube 56 disclosed in EP-A-0,417,662. Such thread manipulation suction tubes used in robots and in spinning machine are well known per se. As described below tubes 2,3, shown schematically in FIG. 1, are typically connected together within a unitary component such as suction tube 35 in parent application U.S. Ser. No. 919,876 or tube 56 disclosed in EP-A-0,417,662 with tubular channel 2 being disposed along the length of the upstream side of the suction tube between the disc 1 and the mouth of the suction tube. In a more specific embodiment shown in FIG. 2, the tubes 2,3 are formed as tubular bores or channels in a unitary housing 11 which is disposed at some predetermined point along the length of a suction tube such as tube 35 in U.S. Ser. No. 919,876 or tube 56 in EP-A-0,417,662.

The retrieved yarn 4 is typically routed into the position shown in FIGS. 1, 2 by a suction source which applies the force $F_2$ on the yarn 4. Once the yarn 4 is routed into the position shown in FIG. 1, the yarn on the tube 2 side of the disc 1 is mechanically clamped. The force $F_2$ on the tube 3 side of the yarn 4 is continuously applied by a suction force applied to tube 3. The applied suction force $F_2$ results in an opposing force $F_1$ being applied to the tube 2 side of the yarn 4 by virtue of the yarn 4 being clamped. The resulting force $F_1$ may be applied by mechanical clamping of the yarn either within tube 2 or outside of tube 2. The yarn 4 may be mechanically clamped upstream and outside of tube 2 by simply stopping rotation of the bobbin from which the yarn 4 was initially retrieved and unwound, or by clamping the yarn somewhere along its unwound length in a pair of rollers on the spinning machine or robot which are preprogrammed for this function as described in parent application U.S. Ser. No. 919,876. One embodiment of a mechanical clamp provided within tube 2 is a spring-loaded pressure mechanism (not shown) which controllably presses yarn 4 against the inner wall of tube 2. On the other side of the disc 1 the yarn is grasped in tube 3 by an opposing suction flow from a conventional vacuum source or an air pump (not shown). The opposing suction flow through tube 3 causes a certain tensile force $F_2$ on the other end of the clamped yarn segment. The suction flow through tube 3 is typically effected by selecting a subatmospheric pressure to create a force $F_2$ which is compatible with the elasticity and tensile strength of the yarn 4. In the position shown in FIGS. 1, 2 the yarn segment extending around the surface of the disc 1, is held under tension against the upper surface of the cover 7 spaced apart from the surface of the disc 1. In order to sever the yarn 4 and to form the resulting yarn ends at the same time into the desired shape, the cover 7 must be displaced from the position shown in FIG. 1 to another position such that the cover 7 no longer interferes with the ability of the portion of the yarn in zone 8 to engage the abrasive surface of the disc 1. The cover 7 is then displaced at a predetermined time and the tensioned yarn segment is brought into contact with abrasive disc 1 in zone 8 having the predetermined angle of wrap $\alpha$ and the yarn segment is abraded until the separation takes place. Yarn residues and fluff remaining after grinding by the surface of the disc 1 are removed by the vacuum source or air pump, whereby the severed waste yarn and fluff are collected in a container (in a kind of vacuum cleaner) (not shown) in a known manner. Depending on the grain size K of the abrasive disc 1 the individual fibers are either increasingly pulled off from the yarn (coarse grain size) or the yarn is gradually abraded off (fine grain size). Furthermore, the shape of the yarn ends depends on the period of contact with the abrasive disc 1, i.e., even after the yarn is severed, the yarn end may be continued to be abraded, which leads to a shortening of the yarn end. In addition, the direction of rotation and the speed of the abrasive disc 1 is also decisive for the shape of the yarn end and may be selected according to the invention. When the disc 1 rotates clockwise the yarn end will be acute. A counter-clockwise rotation will lead to a "brush-like" yarn end. Control of the disc speed is necessary for avoiding thermal damage to the yarn end, which is particularly important in connection with yarns mixed with chemical fibers. The angle of wrap $\alpha$ is typically selected by preselecting the distances a and b at a predetermined diameter d of abrasive disc 1. The angle of wrap $\alpha$, the diameter d and the tensile force $F_2$ are typically selected on the basis of the staple fiber length of yarn 4, which enables optimization of the geometry of the yarn end for piecing.

A preferred embodiment of the generic separating apparatus and method described above is shown with reference to FIG. 1 in FIG. 2. Tubes 2 and 3 (for the sake of simplicity are configured as bores or tubes or tubular channels disposed in unitary housing body 11) open out tangentially into a cylindrical duct 12 which has a slightly larger diameter than the diameter of abrasive disc 1 which is notatably mounted therein.

Tubes 2 and 3 are disposed at a right angle towards one another. In this manner the above-mentioned angle of wrap $\alpha$ is achieved. The yarn holding cover 7 is configured in this embodiment as a semi-cylindrical shield 7 which is controllably rotatable about the axle 6 of the abrasive disc 1 between positions where the yarn segment is held apart from engagement with the disc surface and where the yarn segment may engage the disc surface as shown in FIG. 1. Alternatively the cover 7 can be displaceable in the axial direction between such positions. As described above, in a typical piecing or start spinning process, the cover 7 is initially disposed over the disc surface in the abrasive zone 8 when the yarn 4 is initially withdrawn into and through tubes 2, 3, and the yarn on the tube 2 side of the disc 1 is mechanically clamped before the cover 7 is displaced from its position holding the yarn segment apart from the disc surface. The cylindrical duct 12 thus forms in combination with shield 7 a continuous yarn guiding duct, such that suction flow from the vacuum pump effecting the flow through tube 3 communicates with tubular channel 2. With the help of the yarn guiding duct, yarn 4 is pulled into the continuous duct (only partly visible in the drawing) of a flexible suction tube by suction flow as described, for example, in U.S. Ser. No. 919,876 and EP-A-0 417 662. As shown in FIG. 3, cylindrical bores are provided in the housing 11 laterally to tubes 2. A light emitting diode (LED) 13 and a photo-sensitive cell 14 are provided in the bore, which act as a yarn detecting mechanism. Such a yarn detection mechanism may also be provided along tube 3 in order to monitor the yarn separating or yarn end processing process.

FIG. 3 shows further details of the embodiment of FIG. 2. Tubes 2 and 3 may be arranged at a variety of angles relative to each other whereby the angle of wrap $\alpha$ can be readily selected. To this end, engaging ring-like steps may be provided at a variety of positions around the perimeter of duct 12 such that tubes 2, 3 may be adjustably mounted in fixed positions with their axes disposed at a variety of selectable angles relative to each other. As can be clearly seen, the abrasive surface of the disc 1 is slightly concave in the yarn guiding zone, such that the tensioned yarn segment is guided towards the center of the disc surface during the abrasion, and even a severed yarn end which is no longer urged by tension after being severed, will tend to be guided into the concave surface, FIG. 3, and continue to be abraded. Shaft 15 of abrasive disc 1 is held in housing 11 by schematically shown bearings 16. Shaft 15 is controllably drivable with an electromotor (not shown) by means of a clutch 17. Alternatively, an air turbine may be employed. An electromotor is preferable, however, because the speed can be controlled more precisely and quickly. The electromotor control typically comprises a potentiometer, but may, however, also comprise other conventional mechanisms such as an electronic voltage control mechanism.

It is therefore possible to choose the speed and the abrasive time according to the properties of the yarn.

To select the strength of the tensile yarn force $F_2$, an injector or venturi 18 may be provided in tube 3 (as shown in FIG. 4). The injector 18 comprises a narrower cylindrical duct 19 opening out into a substantially wider duct 20. The inner end 21 of the duct 20 communicates with an annular recess 22. The recess 22 can be supplied with compressed air via a bore 23. A throttle pin 24 may be provided for regulating the air quantity and thus the air pressure. The pin 2& can be set manually or by means of a small electromotor (for example on the basis of a piezoelectric Crystal). Alternatively, the throttle pin 24 may be mechanically controlled through a bimetallic strip or by means of a proportional valve.

The yarn detector mechanism shown in FIG. 2 can be provided both in the suction tube 2, as well as the exhaust tube 3. The detection mechanism can also be used as signal transmitter for signalling the presence of yarn in a thread manipulation tube at a particular time on which the occurrence of other events in a subsequent piecing process may be initiated and/or carried out in a predetermined sequence. As described in parent application U.S. Ser. No. 919,876, the thread detector 35' is disposed along the thread manipulation tube 35 upstream of the yarn severing mechanism and upon detection of the yarn being withdrawn into tube 35 to the point where detector 35' is disposed, a signal is sent which causes certain other events in a piecing process-to occur such as movement of the disc cover or shield to a non-interference position, controlled rotation of the abrasive disc, withdrawal of the severed yarn end and the like. Further details of an exemplary time sequenced process are described in U.S. Ser. No. 919,876 and in EP-A-0 417 662. The embodiments of the abrasive elements as described above and shown in FIGS. 2 and 3 are to be provided at the end of the tube designated with reference numeral 56. The clamping of the yarn is then made by the draw-off rollers 35 and 36, which are brought together again for the actual piecing.

When an apparatus as described above might be used in conjunction with a thread manipulation suction tube such as tube 35 in parent application U.S. Ser. No. 919,876 or tube 56 as described in EP-A-0 417 662 the yarn end to be pieced(in this case the yarn end on the tube 2 side of disc 1) is withdrawn from tube 2 according to a timed and controlled sequence (e.g. by draw-off rollers 6,6' in U.S. Ser. No. 919,876 or rollers 35, 36 in EP-A-0 417 662) and ultimately mated with an appropriately newly delivered fiber aggregate, fiber sliver or stream of fibers for piecing or joining whereby the spinning process is renewed.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. Apparatus for severing a yarn into separated yarn ends and processing at least one separated yarn end for piecing up, the apparatus comprising:

a disc mechanism having an abrasive circumferential surface and being controllably rotatable around an axis;

means for holding a selected length of the yarn under a predetermined tension in relationship to the abrasive surface of the disc such that at least a portion of the tensioned length of yarn is urged toward engagement with the abrasive surface of the disc by the tension;

the abrasive surface of the disc and the yarn holding means being mounted in relationship to each other such that the one separated yarn end is severed by a circumferential abrasive action and process for piecing up;

the yarn holding means being arranged relative to the abrasive surface of the disc such that the selected length of yarn extends around the abrasive surface of the disc at a predetermined angle of wrap selected for severing and processing the one separated yarn end.

2. Apparatus of claim 1 wherein the yarn holding means comprises at least one suction tube adapted to exert a suction force on the yarn via a subatmospheric pressure flow through the tube.

3. Apparatus of claim 1 wherein the yarn holding means comprises first and second tubular channels each having an axis, the yarn being held within the channels and the selected length of yarn extending between the channels under tension.

4. Apparatus of claim 3 wherein the axes of the tubular yarn holding channels are disposed at an angle greater or equal to 0° and equal or less than 180° relative to each other.

5. Apparatus of claim 4 wherein the axes of the tubular yarn holding channels are disposed at about 90 degrees relative to each other.

6. Apparatus of claim 3 further including means for adjustably mounting the yarn holding channels such that the axes of the channels are disposable at any selected angle relative to each other.

7. Apparatus of claim 3 wherein at least one of the yarn holding channels includes a sensor for detecting the presence of the yarn disposed within the channel.

8. Apparatus of claim 7 wherein the sensor comprises a light emitting mechanism mounted on the at least one yarn holding mechanism such that a beam of light is emitted across a predetermined path through the channel and a light detecting mechanism aligned along the predetermined path of the beam.

9. Apparatus for severing a yarn into separated yarn ends and processing at least one separated yarn end, the apparatus comprising:

a disc mechanism having an abrasive circumferential surface and being controllably rotatable around an axis;

means for holding a selected length of the yarn under a predetermined tension in relationship to the abrasive surface of the disc such that at least a portion of the tensioned length of yarn is urged toward engagement with the abrasive surface of the disc by the tension;

the abrasive disc and the yarn holding means being mounted in stationary relationship to each other;

the yarn holding means being arranged relative to the abrasive surface of the disc such that the selected length of yarn extends around the abrasive surface of the disc at a predetermined angle of wrap; and a cover mechanism for holding the selected length of tensioned yarn away from engagement with the abrasive surface of the disc, the cover mechanism being mounted such that the cover shields a portion of the abrasive surface of the disc.

10. Apparatus of claim 9 wherein the cover mechanism is controllably movable between a first holding position disposed between the abrasive surface of the disc and the selected length of yarn and a second position displaced away from the holding position such that the selected length of yarn is engageable with the abrasive surface of the disc.

11. Apparatus of claim 10 wherein the cover mechanism is rotatably mounted such that the cover mechanism is controllably rotatable around the abrasive surface of the disc between the first yarn holding position and the second displaced position.

12. Apparatus of claim 11 wherein the cover mechanism is mounted Such that the cover mechanism is movable between the first holding and second displaced positions along a path having a directional component which is parallel to the axis of rotation of the disc element.

13. Method for selectively forming and processing a yarn end for use in piecing or starting up spinning in a textile spinning machine, the method comprising:

selecting a disc having a predetermined diameter and an abrasive circumferential surface;

retrieving a spun yarn under tension around the abrasive surface of the disc at an angle of wrap selected to sever the yarn portion and form a yarn end having a predetermined shape for piecing;

the portion of the retrieved yarn being held in a yarn holding mechanism such that the tensioned portion of the yarn is urged toward engagement with the abrasive surface of the disc by the tension, the disc being mounted such that its axis of rotation is stationary relative to the yarn holding mechanism;

rotating the disc at one or more selected speeds and in one or more selected directions for one or more selected lengths of time to sever the portion of the retrieved yarn wrapped around the abrasive surface of the disc at the predetermined angle of wrap such that at least one severed yarn end is formed by a circumferential abrasive action for use in piecing or start spinning in the spinning machine.

14. Method of claim 13 wherein the step of rotating the disc further comprises continuing to rotate the disc subsequent to severance of the yarn at one or more selected speeds and in one or more selected directions for one or more selected times such that the at least one yarn end is further prepared for use in piecing or start spinning in the spinning machine.

15. Method of claim 13 wherein one or more of the angle of wrap, the diameter of the disc and the degree of tension under which the portion of the yarn is held are selected according to the staple fiber length of the yarn.

16. The method of claim 13 wherein the step of holding comprises mechanically clamping the yarn on one side of the portion of the yarn held around the surface of the disc and suctionably holding another opposing side of the portion of the yarn held around the surface of the disc.

17. Method for selectively forming and processing a yarn end for use in piecing or starting up spinning in a textile spinning machine, the method comprising:

selecting a disc having a predetermined diameter and an abrasive circumferential surface;

retrieving a spun yarn on the spinning machine;

holding a portion of the retrieved yarn under tension around the abrasive surface of the disc at an angle of wrap selected to sever the yarn portion and form a yarn end having a predetermined shape;

the portion of the retrieved yarn being held in a yarn holding mechanism such that the tensioned portion of the yarn is urged toward engagement with the abrasive surface of the disc by the tension, the disc being rotatably mounted on an axis of rotation, the disc being mounted such that its axis of rotation is stationary relative to the yarn holding mechanism;

rotating the disc at one or more selected speeds and in one or more selected directions for one or more selected lengths of time to sever the portion of the retrieved yarn wrapped around the abrasive surface of the disc at the predetermined angle of wrap such that at least one severed yarn end is formed for use in piecing or start spinning in the spinning machine;

wherein the step of holding comprising holding the portion of the retrieved yarn under tension around a disc cover for a predetermined period of time, the disc cover being disposed between the abrasive surface of the disc and the tensioned portion of yarn such that the tensioned portion of yarn is spaced apart from the abrasive surface of the disc for the predetermined period of time and subsequently moving the disc cover such that the tensioned portion of the held yarn engages the abrasive surface of the disc under the tension.

18. The method of claim 17 wherein the step of holding comprises mechanically clamping the yarn on one side of the portion of the yarn held around the surface of the disc and suctionably holding another opposing side of the portion of the yarn held around the surface of the disc.

* * * * *